United States Patent [19]

Meriwether

[11] Patent Number: 4,683,833

[45] Date of Patent: Aug. 4, 1987

[54] HINGE CONNECTOR FOR FLOATING DOCK

[75] Inventor: Jon D. Meriwether, Follansbee, W. Va.

[73] Assignee: Follansbee Steel Corporation, Follansbee, W. Va.

[21] Appl. No.: 859,922

[22] Filed: May 5, 1986

[51] Int. Cl.[4] ..... B63B 35/00; B63B 35/36

[52] U.S. Cl. ..... 114/267; 16/389; 405/220

[58] Field of Search ..... 14/2.6, 27, 28; 114/266, 267, 353; 405/219, 220; 16/382, 389; 52/7, 71

[56] References Cited

U.S. PATENT DOCUMENTS 3,455,115 7/1969 Watts et al. ..... 114/266 X
4,126,006 11/1978 Lewis ..... 405/220

FOREIGN PATENT DOCUMENTS 341281 12/1936 Italy ..... 16/382

*Primary Examiner*—Sherman D. Basinger
*Attorney, Agent, or Firm*—Body, Vickers & Daniels

[57] ABSTRACT

A floating dock having individual dock sections pivotally interconnected by continuous metal hinge connectors to permit relative vertical pivoting movement between adjacent dock sections. The hinge connectors each comprise a pair of elongated metal hinge leafs pivotally interconnected by a pivot pin extending through aligned hinge loops on the hinge leafs. The hinge connectors are secured to adjoining spaced, parallel, portions of the respective dock sections with their pivot pins extending horizontally and lengthwise of the spacing therebetween and with the hinge leafs and their hinge loops bridging and closing the gap between the spaced dock sections at the level of their deck surfaces to form continuations thereof. The hinge leafs are preferably formed with depending side anchor leg portions for securing them to the dock sections, and their hinge loops are preferably located on their underside.

20 Claims, 2 Drawing Figures

HINGE CONNECTOR FOR FLOATING DOCK

The present invention relates in general to floating docks and, more particularly, to a hinge connector for pivotally interconnecting adjacent dock sections of a floating dock to permit vertical pivoting movement therebetween.

BACKGROUND OF THE INVENTION

Floating dock systems such as are in general use at present are generally comprised of two or more individual, self-buoyant, dock sections which are hinged to one another to permit relative vertical pivotal movement therebetween as dictated by the momentary surface wave conditions of the body of water on which the dock is floating. The individual dock sections are provided with suitable air-tight float drums, generally of blow molded polyethylene form, which are secured to the underside of the dock sections to float them atop the surface of the water.

Heretofore, the hinged interconnection of the dock sections of such floating docks to one another has generally been accomplished by simply threading a suitable diameter metal pipe or rod either through a series of sturdy eyebolts secured in aligned relation in the adjoining opposed vertical faces of the dock sections or through aligned bearing openings in pairs of metal bearing plates secured to the vertical sides of the respective adjoining dock sections and projecting outwardly therefrom. In either case, a sizeable gap opening is left between the adjoining dock sections extending across the full width of the deck planking on the dock sections. These gap openings between the dock sections then constitute a danger to persons walking on the decks thereof, especially to barefooted bathers or boaters for instance, in that their feet or toes may be caught and pinched between the pivoting dock sections such as to cause serious injury thereto including broken bones.

Moreover, such prior type hinged connections for floating docks, besides being unsafe and apt to cause the aforementioned physical injury to persons using these docks, have been of rather crude and unsightly appearing form such as to detract from an otherwise attractive appearing floating dock construction.

SUMMARY OF THE INVENTION

The present invention contemplates a new and improved floating dock construction having a hinge connector for the dock sections thereof which overcomes all of the above referred to problems and others and eliminates the danger of physical injury at the hinged connection to persons using the dock by reason of the pivotal movement normally occurring between the dock sections.

Briefly stated, in accordance with one aspect of the invention, adjacent spaced dock sections of a floating dock are pivotally interconnected for relative vertical pivotal movement by a hinge connector which spans and completely closes the gap between the spaced dock sections and which lies approximately level with and forms a continuation of the decking thereon.

In accordance with a further aspect of the invention, the hinge connector is comprised of an elongated continuous double leaf metal hinge more or less corresponding in length to the distance across the frames of the adjoining dock sections at their hinged connection, with axially aligned pivot pin receiving hinge loops on the hinge leafs formed on the underside thereof so as not to project above the decking of the dock sections.

According to a still further aspect of the invention, the hinge loops on the respective hinge leafs of the hinge connector snugly interfit or mesh and axially align with one another on insertion of the pivot pin of the connector therethrough, whereby no dangerous gap or catch openings are present at the hinged connection between the hinge loops such as might cause injury to persons using the the floating dock.

In accordance with yet another aspect of the invention, the hinge leafs of the hinge connector are formed of L-shaped cross-section to provide depending anchor leg portions for securing to the facing spaced sides of the adjoining dock sections to effect the interconnection thereof by the hinge connector.

The principal object of the invention is to provide a novel hinged connection between adjoining spaced dock sections of a floating dock which is of sturdy and secure character and which will not cause physical injury thereat to persons using the dock.

Another object of the invention is to provide a hinged connection for the adjoining dock sections of a floating dock which is of attractive appearing and safe character.

Still another object of the invention is to provide a hinge connector for pivotally interconnecting adjoining spaced dock sections of a floating dock and completely spanning and covering the gap between the spaced dock sections at the level of the decking thereon to form an uninterrupted continuation of the decking across the gap between the connected dock sections.

A further object of the invention is to provide a floating dock having adjoining spaced dock sections pivotally interconnected for vertical pivotal movement therebetween by a novel hinge connector which is of sturdy and safe operating form unlikely to cause physical injury thereat resulting from the pivotal movement between the dock sections.

Further objects and advantages of the invention will appear from the following detailed description of a preferred species thereof and from the accompanying drawings.

DESCRIPTION OF THE PREFERRED EMBODIMENT

Figure 1:
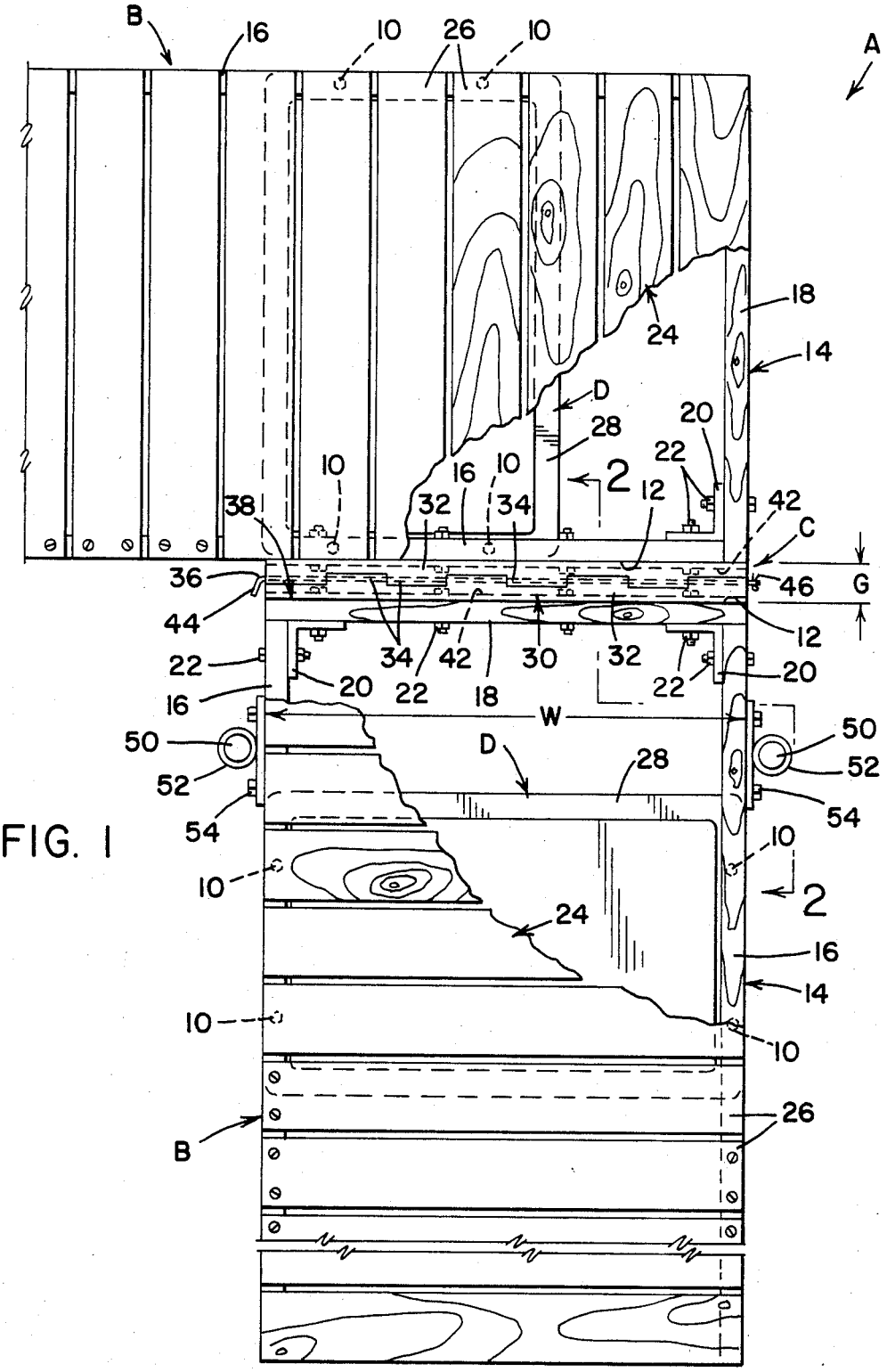
FIG. 1 is a plan view of a floating dock according to the invention with individual dock sections joined together by a hinge connector comprising the invention; and, FIG. 2 is an enlarged sectional view on the line 2—2 of FIG. 1 showing the hinge connector in cross-section.

Referring now to the drawings wherein the showings are for the purpose of illustrating a preferred embodiment of the invention only and not for the purpose of limiting same, the figures show a floating dock A comprised of a plurality (two in the particular case illustrated) of individual dock sections B which are hingedly connected in adjoining spaced relation to one another by a hinge connector C comprising the invention for permitting vertical pivoting movement between the hingedly connected dock sections B. The individual docks B are each provided at their underside with a plurality of conventional float drums D, suitably formed of blow molded polyethylene and secured to the underside of the dock sections as by fastening screws 10, for effecting the flotation of the dock sections on whatever body of water they may be placed. By virtue of their hinged connection at C, the dock sections B are free to undergo vertical pivotal movement relative to one another as imparted thereto by the momentary surface wave conditions of the body of water on which the dock sections are floated.

The dock sections B may be of any suitable platform like construction each having a straight side portion 12 adapted for hingedly connecting together in opposed facing parallel and closely spaced relation to one another, as shown. In the case of the representative floating dock A illustrated, the dock sections B are shown as each comprised of a rectangular shaped wooden frame 14 formed of a pair of elongated, parallel extending, side beam members 16 suitably connected together at their ends by end beam members 18 secured to the side beam members 16 by galvanized steel corner brackets 20 bolted to the beam members 16,18 by galvanized steel fastening bolts 22. The beam members 16,18 may be suitably formed of 2"×8" wood beams, for instance. The dock sections B, as defined by the rectangular frames 14 thereof, may have representative dimensions of 10 feet in length and around 38" in width. However, where desired, the dock sections B may be made of wider dimensions such as, for example, 78" and in some cases 117" in width.

The dock sections B are provided with a flat top decking 24 suitably formed, for instance, of a plurality of wooden deck boards 26 such as 2"×6" treated yellow pine planks secured, as by means of wood screws for example, to the top of the wooden frame 14 in side-by-side relation extending transversely thereacross so as to lie in a common horizontal plane when the dock sections B are floating and at rest on a quiescent body of water. The deck boards 26 preferably are of a length matching the width of the frame 14 so as to be coterminous therewith.

The float drums D which, as indicated above, are secured to the underside of the dock sections B are each provided therearound with an outwardly extending circumferential mounting flange 28 formed with apertures for receiving the fastening screws 10 which secure the flange 28 of the drum D to the underside of the side beam members 16 of the frame 14 to thus mount the drum thereon. The number of float drums D employed to float each dock section B will, of course, depend on the overall size of the respective dock section and the maximum load to which it is to be subjected in normal use. For most cases, however, involving dock sections of, for example, 10 foot length and around 38" width, two conventional type blow molded polyethylene float drums, of dimensions approximating 36" in length, 24" in width, and 11" in height and mounted adjacent the opposite ends of the respective dock sections B as shown in the drawings, will generally suffice for most purposes.

The hinge connector C comprising the invention for pivotally interconnecting the dock sections B together to form the floating dock A, comprises an elongated, continuous, double leaf metal hinge 30 similar to that commonly referred to as a piano hinge and formed of a pair of elongated, identical form, metal hinge leafs 32 preferably of galvanized No. 8 gauge sheet steel and each provided along one of their longitudinal edges with a series of hinge loops or curls 34 spaced apart therealong and axially aligned with one another for receiving a $\frac{5}{8}$" or so diameter galvanized steel hinge or pivot pin 36 therein for pivotally interconnecting the two hinge leafs 32. The double leaf hinge 30 is of a length approximately corresponding to the width W of that one of the dock sections B which is hingedly connected at its end 38 to the longitudinal side of the other one of the dock sections. Thus, in the case of dock sections B having a width W of approximately 38" and hingedly connected by hinge connector C in the manner as shown in FIG. 1, with one of the dock sections hingedly connected across the width W thereof at one of its ends 38 to the longitudinal side of the other dock section, the double leaf hinge 30 is of a length of 38" approximately corresponding to the 38" width W of such one dock section at its one end 38.

The hinge 30 is secured to the respective dock sections B so as to hold them together with their side portions 12 extending parallel to each other in facing spaced apart relation to form the gap G therebetween, and with the hinge pin 36 of the hinge 30 extending horizontally, and parallel to and approximately medially between the facing spaced side portions 12 of the dock sections. Gap G is made of sufficient width to permit the hinged dock sections B to freely undergo whatever degree of vertical pivotal movement therebetween to which they might be subjected by all normal surface wave conditions of the body of water on which the dock A is floated. To this end, a gap G of around 3" or so has been found to be adequate for most purposes. Such a gap G width will permit up to around 25° or so of vertical pivotal movement between the dock sections B in either pivoting direction.

As shown, the hinge 30 is secured to the adjoining dock sections B with its hinge leafs 32 completely spanning the gap G between the side portions 12 of the dock sections and lying more or less in the planes P of, and level or flush with the top surfaces 40 of the decking 24 on the respective dock sections whereby to form, in effect, continuations of these decking surfaces. The hinge leafs 32 of the hinge 30 thus completely close or fill in the gap G between the facing surfaces 12 of the hinged dock sections B so that no dangerous openings or clefts are present therebetween, at the level of the top surfaces 40 of the decking 24, within which the hands or feet of persons using the floating dock may be accidentally caught and pinched, during the relative pivotal movement of the dock sections, to possibly cause serious physical injury such as broken or crushed toes or finger bones.

Figure 2:
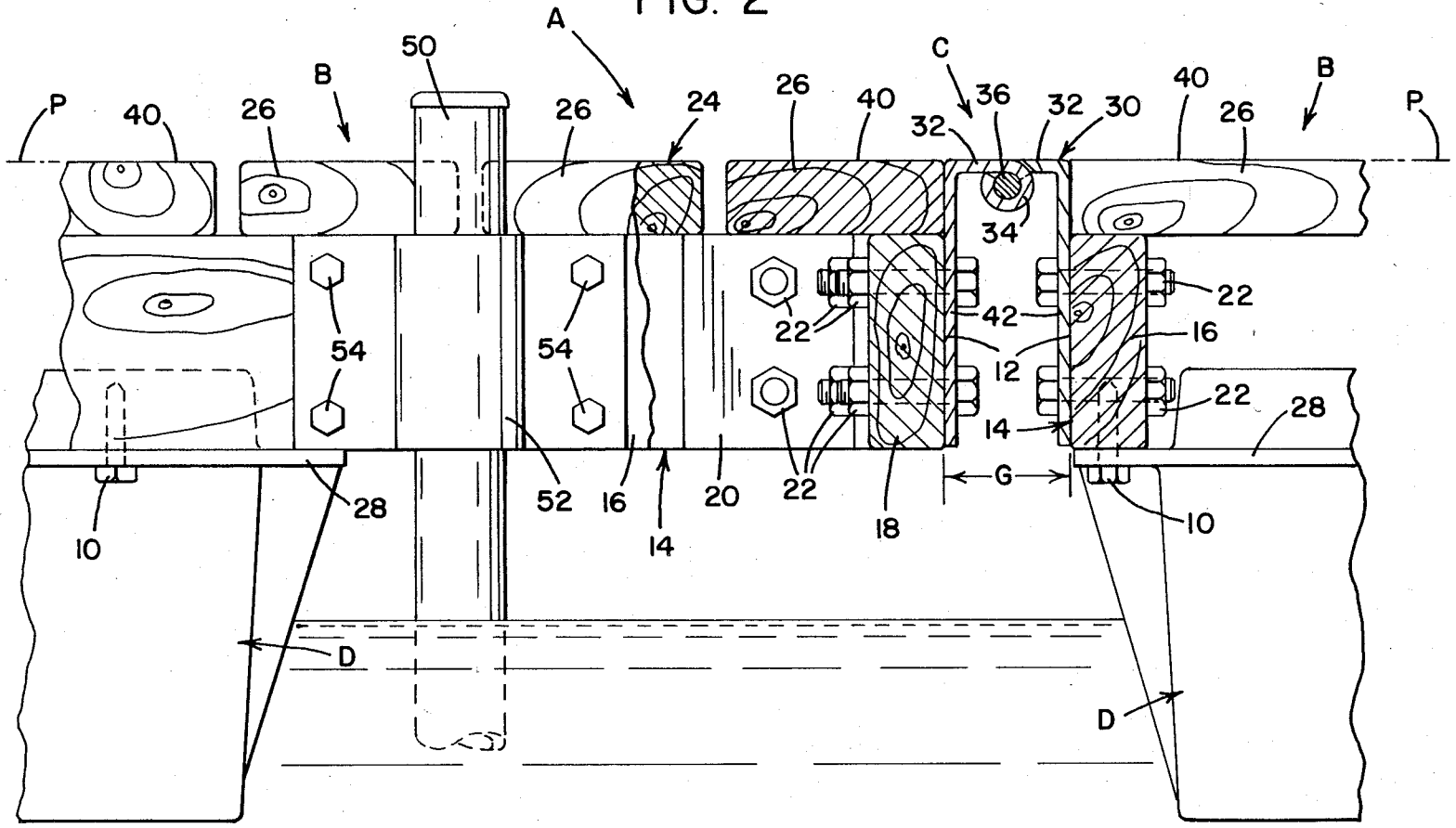

The hinge loops or curls 34 provided on the hinge leafs 32 of hinge 30 are preferably formed on the immediate underside thereof, as shown in FIG. 2, so as not to constitute dangerous upstanding projections extending above the flat top surface 40 of the decking 24 on the respective dock sections B such as would interrupt the flat continuity thereof and might cause persons walking on the floating dock A to trip and stumble on the raised projections and possibly fall either onto the dock itself or into the body of water alongside the dock with likelihood of serious physical injury. Also, the hinge loops 34 on the hinge leafs 32 of hinge 30 are of identical cylindrical-like tubular form, with the axially aligned hinge loops on each hinge leaf axially spaced apart a distance corresponding to the axial length of the individual hinge loops so that the hinge loops on the two hinge leafs of the hinge 30 will snugly interfit and mesh between one another, as shown in FIG. 1, when they are axially aligned to permit insertion of the hinge pin 36 therethrough. The so meshed hinge loops 34 of the pivotally connected hinge leafs 32 thus contribute to the closing and filling in of the gap or space G between the hingedly connected dock sections B by the hinge 30, with no openings or clefts present therein.

To provide a conveniently made and firm attachment of the hinge leafs 32 of hinge 30 to the adjoining dock sections B and at the same time establish the size of the gap G therebetween, the hinge leafs are provided with depending elongated anchor leg portions or wing extensions 42 for securing adjacent each end thereof flatwise to the facing side portions 12 of the dock sections B as by means, for example, of the same fastening bolts 22 used to secure the metal corner brackets 20 to the end beams 18 of the frames 14 of the dock sections. The depending anchor leg portions 42 extend the full length of the hinge leafs 32 and parallel to the axes of the hinge loops 34 on the respective hinge leafs and to the hinge pin 36 extending therethrough. In the case of the particular form of dock sections B illustrated wherein their adjoining facing side portions 12 extend at approximately right angles to the planes P of the top surfaces 40 of the deckings 24 on the respective dock sections, the depending anchor leg portions 42 extend approximately perpendicularly to the respective hinge leafs from the outward longitudinal edges thereof, and they are preferably formed by the downward bending of the wing extensions 42 on the hinge leafs to extend at approximately right angles or perpendicularly thereto.

The connecting together of the dock sections B by means of the hinge connector C comprising the invention to form the floating dock A is accomplished simply by meshing and axially aligning the hinge loops 34 of the hinge leafs 32 on the respective dock section with one another, and then inserting the hinge pin 36 through the aligned hinge loops 34 to complete the assembly of the hinge connector C and the pivotal interconnection of the dock sections to form the floating dock A. The inserted hinge pin 36 is suitably locked in place in its inserted position in the hinge loops 34 against accidental axial withdrawal therefrom as by being provided at one end with locking shoulder means such as the illustrated bent end leg 44 or an upset head end, and being provided at its projecting other end with a cotter pin 46 inserted through a transverse aperture in the hinge pin or with some other suitable form of locking means such as a screw-on end cap, for instance.

Although the invention has been described herein as embodied in a floating dock A having dock sections B formed with wood frames 14, it should be understood that it is applicable as well to other forms of floating docks such as those employing dock sections B with dock frames 14 formed of galvanized steel channel members instead of the illustrated wooden beams 16 and 18 and suitably secured together by galvanized steel corner brackets similar to those illustrated at 20.

In installing the floating dock A, one of the dock sections thereof is suitably mounted at one end, as is customary practice, in anchored position on the shore of the body of water on which the dock is to be floated. To prevent any drifting of the other dock sections B and maintain them in a set floating location on the body of water, one or more of the dock sections B may be provided with suitable anchoring means in the form, for example, of a plurality of vertically extending, galvanized steel anchoring pipes 50 suitably secured at widely spaced locations on the side and/or end beams 16, 18 of the respective dock frames 14, within galvanized steel holder brackets 52 thereon, to permit a limited degree of relative movement therebetween. The holder brackets 52 are suitably secured to the side or end beams 16, 18 of the dock frames 14 as by galvanized steel fastening bolts 54. The anchoring pipes 50 may be provided at their bottom ends either with augurs or mud pads (not shown) for either drilling into and embedding within, or resting and anchoring on the bottom of the body of water on which the dock is floated.

In the use of the floating dock A according to the invention, the hinge connector C joining the two floating dock sections B together permits them to freely pivot vertically relative to one another about the hinge pin 36 in response to the momentary surface wave conditions of the body of water on which the dock A is floating. Besides affording a sturdy and attractive hinged connection between the floating dock sections B, the hinge connector C comprising the invention provides a safe connection between the dock sections which completely closes and fills in, at the level of the top surfaces 40 of the decking 24 on the dock sections, the necessary gap or spacing G which must be provided between the dock sections to permit their vertical pivotal movement relative to one another at the hinge connector C. As a consequence, no dangerous openings or clefts, or any raised projections, are present at the hinge connector C such as might result in the catching and pinching therein of the fingers or toes of persons walking on or otherwise using the floating dock A while the dock sections B thereof are undergoing relative vertical pivoting movement, or might result in the stumbling and falling of such persons onto the dock itself or possibly into the adjacent body of water, with consequent possibility of physical injury.

Having thus described the invention, it is claimed:

1. A hinge connector for pivotally interconnecting a pair of floating dock sections in adjoining spaced relation, said hinge connector comprising a pair of elongated metal hinge leafs pivotally interconnected by a hinge pin extending through aligned hinge loops on said hinge leafs located along respective ones of the longitudinal edges thereof, said hinge connector being adapted for securing to adjoining spaced side portions of said dock sections with the said hinge pin extending horizontally, and lengthwise and medially of the spacing between said adjoining side portions of the dock sections, and with the said hinge leafs horizontally bridging and closing the gap between the said spaced side portions of the dock sections at approximately the level of the deck surfaces thereof to effectively form a continuation of the said deck surfaces, the said secured hinge connector pivotally interconnecting said dock sections for vertical pivoting movement both upwardly and downwardly about the said hinge pin through an appreciable angle.

2. A hinge connector as defined in claim 1, wherein the said hinge loops on the said hinge leafs secured to said spaced dock sections are located at the immediate underside of the hinge connector.

3. A hinge connector as defined in claim 2, wherein the said hinge leafs are formed with anchor leg portions depending from the other one of the respective longitudinal edges of each of said hinge leafs for securing the hinge leafs to the said adjoining spaced side portions of said dock sections.

4. A hinge connector as defined in claim 3, wherein the said depending anchor leg portions of said hinge leafs extend approximately perpendicularly therefrom and parallel to the said hinge pin.

5. A hinge connector as defined in claim 3, wherein the said hinge leafs are each provided with a plurality of said hinge loops projecting from and spaced apart in axially aligned relation along the respective adjoining longitudinal edges of the hinge leafs so as to conjointly mesh between and axially align with one another for insertion of the said hinge pin through said aligned hinge loops.

6. A hinge connector as defined in claim 2, wherein the said hinge leafs are each provided with a plurality of said hinge loops projecting from and spaced apart in axially aligned relation along the respective adjoining longitudinal edges of the hinge leafs so as to conjointly mesh between and axially align with one another for insertion of the said hinge pin through said aligned hinge loops.

7. A hinge connector as defined in claim 1, wherein the said hinge leafs are formed with anchor leg portions depending from the other one of the respective longtudinal edges of each of said hinge leafs for securing the hinge leafs to the said adjoining spaced side portions of said dock sections.

8. A hinge connector as defined in claim 7, wherein the said depending anchor leg portions of said hinge leafs extend approximately perpendicularly therefrom and parallel to the said hinge pin.

9. A hinge connector as defined in claim 1, wherein the said hinge leafs are each provided with a plurality of said hinge loops projecting from and spaced apart in axially aligned relation along the respective adjoining longitudinal edges of the hinge leafs so as to conjointly mesh between and axially align with one another for insertion of the said hinge pin through said aligned hinge loops.

10. A floating dock comprised of a pair of dock sections provided with plank decking and pivotally connected to one another, along adjoining, spaced, horizontally and parallel extending side portions of the dock sections, by an elongated continuous hinge connector positioned between and secured to said adjoining spaced side portions of the dock sections and normally maintaining the said decking of said connected dock sections in a common horizontal plane while permitting relative vertical pivoting movement between said dock sections both upwardly and downwardly from said horizontal plane through an appreciable angle, said hinge connector comprising a pair of elongated metal hinge leafs horizontally bridging and closing the gap between the said spaced side portions of the dock sections at the level of the deck surfaces thereof to effectively form a continuation of the said deck surfaces, said hinge leafs being provided along their adjoining longitudinal edges with hinge loops aligned horizontally with one another along a common pivot axis extending parallel to said adjoining parallel side portions of the dock sections, and a hinge pin extending horizontally through said aligned hinge loops to pivotally interconnect said hinge leafs.

11. A floating dock as defined in claim 10, wherein the said hinge loops on the said hinge leafs are located at the immediate underside of the hinge connector.

12. A floating dock as defined in claim 11, wherein the said hinge leafs are formed with anchor leg portions depending from the longitudinal edges of said hinge leafs other than their said adjoining longitudinal edges for securing the hinge leafs to the said adjoining spaced side portions of said dock sections.

13. A floating dock as defined in claim 12, wherein the said depending anchor leg portions of said hinge leafs extend approximately perpendicularly therefrom and parallel to the said hinge pin.

14. A floating dock as defined in claim 12, wherein the said hinge leafs are each provided with a plurality of said hinge loops projecting from and spaced apart in axially aligned relation along the respective adjoining longitudinal edges of the hinge leafs, the said hinge loops of the pivotally interconnected hinge leafs being meshed between one another.

15. A floating dock as defined in claim 11, wherein the said hinge leafs are each provided with a plurality of said hinge loops projecting from and spaced apart in axially aligned relation along the respective adjoining longitudinal edges of the hinge leafs, the said hinge loops of the pivotally interconnected hinge leafs being meshed between one another.

16. A floating dock as defined in claim 10, wherein the said hinge leafs are formed with anchor leg portions depending from the longitudinal edges of said hinge leafs other than their said adjoining longitudinal edges for securing the hinge leafs to the said adjoining spaced side portions of said dock sections.

17. A floating dock as defined in claim 16, wherein the said depending anchor leg portions of said hinge leafs extend approximately perpendicularly therefrom and parallel to the said hinge pin.

18. A floating dock as defined in claim 10, wherein the said hinge leafs are each provided with a plurality of said hinge loops projecting from and spaced apart in axially aligned relation along the respective adjoining longitudinal edges of the hinge leafs, the said hinge loops of the pivotally interconnected hinge leafs being meshed between one another.

19. A hinge connector as defined in claim 1, wherein the said pivotally interconnected dock sections are vertically pivotable about the said hinge pin both upwardly and downwardly from their normal horizontally disposed position through a total angular extent relative to one another of at least around 25°.

20. A floating dock as defined in claim 10, wherein the said pivotally interconnected dock sections are vertically pivotable about the said hinge pin both upwardly and downwardly from their normal horizontally disposed position through a total angular extent relative to one another of at least around 25°.

* * * * *